US008098027B2

(12) United States Patent
Tsai et al.

(10) Patent No.: US 8,098,027 B2
(45) Date of Patent: Jan. 17, 2012

(54) LIGHT-EMITTING DEVICE DRIVING CIRCUIT FOR DYNAMICALLY ADJUSTING TURN-OFF TIME LENGTH OF SWITCH

(75) Inventors: Ming-Heng Tsai, Hsinchu (TW); Yi-Chung Chou, Taipei (TW)

(73) Assignee: ITE Tech. Inc., Hsinchu (TW)

( * ) Notice: Subject to any disclaimer, the term of this patent is extended or adjusted under 35 U.S.C. 154(b) by 673 days.

(21) Appl. No.: 12/238,455

(22) Filed: Sep. 26, 2008

(65) Prior Publication Data

US 2009/0315473 A1 Dec. 24, 2009

(30) Foreign Application Priority Data

Jun. 18, 2008 (TW) ..... 97122694 A

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| *H05B 37/00* | (2006.01) |
| *H05B 39/00* | (2006.01) |
| *H05B 39/02* | (2006.01) |
| *H05B 41/00* | (2006.01) |

(52) U.S. Cl. ..... 315/307; 315/209 R; 315/210; 315/291; 315/294; 315/297; 315/312

(58) Field of Classification Search ..... None
See application file for complete search history.

(56) References Cited

U.S. PATENT DOCUMENTS

| | | | | |
|---|---|---|---|---|
| 6,043,635 | A * | 3/2000 | Downey | 323/282 |
| 6,091,305 | A * | 7/2000 | Nagoya et al. | 331/17 |
| 6,438,257 | B1 * | 8/2002 | Morimura et al. | 382/124 |
| 7,115,888 | B2 * | 10/2006 | Hachiya et al. | 250/552 |
| 7,245,089 | B2 * | 7/2007 | Yang | 315/307 |
| 2009/0273292 | A1 * | 11/2009 | Zimmermann | 315/209 R |

OTHER PUBLICATIONS

Huang, J.C.,Digital Logic Design,Chapter 6,[online],2004[retreived on Jun. 2, 2011].Retreived from the Internet:<URL:http://www2.cs.uh.edu/~jhuang/JCH/LD/chapter6h.pdf>.*

* cited by examiner

*Primary Examiner* — Douglas W Owens
*Assistant Examiner* — Dedei K Hammond
(74) *Attorney, Agent, or Firm* — Jianq Chyun IP Office

(57) ABSTRACT

A light-emitting device driving circuit and a method thereof are provided. A terminal of a light-emitting device is coupled to a supply voltage and a cathode of a diode via an inductor, and the other terminal is coupled to an anode of the diode. The light-emitting device driving circuit includes a switch, a current-sensing circuit, and a switch control circuit. The current-sensing circuit is coupled to the anode of the diode via the switch to determine whether or not to generate a turning-off control signal according to a conducting-current value of the switch. The switch control circuit controls an on/off state of the switch, and turns off the switch according to the turning-off control signal. Besides, the switch control circuit compares the conducting-current value with a reference-current value to generate a comparing result to dynamically adjust a time length of turning off the switch accordingly.

13 Claims, 4 Drawing Sheets

LIGHT-EMITTING DEVICE DRIVING CIRCUIT FOR DYNAMICALLY ADJUSTING TURN-OFF TIME LENGTH OF SWITCH

CROSS-REFERENCE TO RELATED APPLICATION

This application claims the priority benefit of Taiwan application serial no. 97122694, filed on Jun. 18, 2008. The entirety of the above-mentioned patent application is hereby incorporated by reference herein and made a part of specification.

BACKGROUND OF THE INVENTION

1. Field of the Invention

The present invention relates to a driving circuit and a method thereof, and more particularly to a light-emitting device driving circuit and a method thereof.

2. Description of Related Art

FIG. 1 shows a conventional buck type light-emitting diode (LED) driving circuit which senses source current of a metal oxide semiconductor (MOS) transistor and a coupling method of the buck type light-emitting diode driving circuit. The light-emitting diode (LED) driving circuit consists of a timing-generating circuit 202, an SR latch 204 positively triggered, an AND gate 206, a switch 208 implemented by an N-type metal oxide semiconductor (NMOS), and a current-sensing circuit 210 so as to drive an LED string 212 formed by a plurality of LEDs. Certainly, the switch 208 may also implemented by P-type metal oxide semiconductors (PMOSs), bipolar junction transistors (BJTs) or other types of transistors. In FIG. 1, a terminal of the LED string 212 is coupled to a direct current (DC) type supply voltage VIN and the cathode of a diode 216 via an inductor 214. The other terminal of the LED string 212 is coupled to the anode of the diode 216.

The timing-generating circuit 202 is used for generating a turning-on control signal TS and changing a timing sequence of the turning-on control signal TS according to a timing control signal EXCS. The current-sensing circuit 210 determines whether or not to generate a turning-off control signal RS according to a value of a conducting-current $I_{DRAIN}$ of the switch 208. Thus, the SR latch 204 can receive from a set terminal S and a reset terminal R the turning-on control signal TS and the turning-off control signal RS respectively, and change an output of an output terminal Q according to the two signals. Consequently, the SR latch 204 controls whether the switch 208 is turned on or off via the AND gate 206 so as to control magnitude of an inductor current $I_L$. As to DIM shown in FIG. 1, it represents a dimming signal in the form of pulse width modulation (PWM), and the dimming signal DIM is used for adjusting luminance of a light source emitted from the LED string 212 and determining whether or not to turn off the switch 208.

FIG. 2 is an oscillogram of the inductor current $I_L$ and the conducting-current $I_{DRAIN}$ of the circuit shown in FIG. 1. Referring to both FIGS. 1 and 2, it is learned from the two drawings when the conducting-current $I_{DRAIN}$ reaches a predetermined peak value $I_{DMAX}$, the switch 208 is turned off and will not be turned on again until after a period of time T. Such operation causes the inductor current $I_L$ to fluctuate between a maximum current value $I_{MAX}$ and a minimum current value $I_{MIN}$ so as to stabilize the luminance of the LED string 212. When the switch 208 is turned off, the current-sensing circuit 210 cannot sense current. Therefore, the conventional LED driving circuit needs the timing-generating circuit 202 to regularly provide the set signal required by the SR latch 204 so as to further control a discharging time of the inductor 214.

However, since the timing-generating circuit 202 depends on the timing control signal EXCS to change the timing sequence of the turning-on control signal TS, when variation in the inductor current $I_L$ exceeds a range defined by the maximum current value $I_{MAX}$ and the minimum current value $I_{MIN}$ and requires the timing sequence of the turning-on control signal TS to be changed, the user must modify a circuit which provides the timing control signal EXCS in order to alter the timing control signal EXCS. Otherwise, an inductor value of the inductor 214 or a number of the LEDs in the LED string 212 needs to be changed to alter the timing control signal EXCS. Such situations cause inconvenience to the user. Further, if the LED driving circuit is manufactured as a circuit chip, additional pins are also required to couple with an external circuit which provides the timing control signal EXCS, which in turn also causes disturbance while designing.

SUMMARY OF THE INVENTION

The present invention is directed to a light-emitting device driving circuit, which locks an inductor current $I_L$ to automatically operate between a maximum current value $I_{MAX}$ and a minimum current value $I_{MIN}$.

The present invention is further directed to a method of driving a light-emitting device, which locks the inductor current $I_L$ to automatically operate between the maximum current value $I_{MAX}$ and the minimum current value $I_{MIN}$.

The present invention provides a light-emitting device driving circuit adapted to driving a light-emitting device. A terminal of the light-emitting device is coupled to a supply voltage and the cathode of a diode via an inductor. The other terminal of the light-emitting device is coupled to the anode of the diode. The light-emitting device driving circuit includes a switch, a current-sensing circuit, and a switch control circuit. The switch has a first terminal, a second terminal, and a control terminal. The first terminal of the switch is coupled to the other terminal of the light-emitting device. The current-sensing circuit is coupled to the second terminal of the switch and determines whether or not to generate a turning-off control signal according to a conducting-current value of the switch. The switch control circuit is coupled to the current-sensing circuit and the control terminal and the second terminal of the switch to control the on/off state of the switch. When the switch is turned on, the switch control circuit compares the conducting-current value of the switch and a reference-current value to generate a comparing result. The switch control circuit turns off the switch according to the turning-off control signal and dynamically adjusts a time length of turning off the switch according the comparing result.

The present invention further provides a light-emitting device driving circuit adapted to driving a light-emitting device. A terminal of the light-emitting device is coupled to a supply voltage and the cathode of a diode. The other terminal of the light-emitting device is coupled to the anode of the diode via an inductor. As to components of the light-emitting device driving circuit, they are the same as those of the foregoing light-emitting device driving circuit.

The present invention further provides a light-emitting device driving method. A terminal of the light-emitting device is coupled to a supply voltage and the cathode of a diode via an inductor. The other terminal of the light-emitting device is coupled to the anode of the diode and a first terminal of a switch. A second terminal of the switch is coupled to a common voltage. The driving method of the light-emitting device includes following steps. First, a signal is provided to a control terminal of the switch to control the on/off state of the switch. Second, whether or not to turn off the switch via the signal is determined by a conducting-current value of the switch. Third, when the switch is turned on, the conducting-current value of the switch and a reference-current value are compared to generate a comparing result, and a time length of turning off the switch is dynamically adjusted according to the comparing result via the signal.

The present invention further provides a light-emitting device driving method. A terminal of the light-emitting device is coupled to a supply voltage and the cathode of a diode. The other terminal of the light-emitting device is coupled to the anode of the diode and a first terminal of a switch via an inductor. A second terminal of the switch is coupled to a common voltage. This light-emitting device driving method is the same as the aforementioned light-emitting device driving method.

According to an embodiment of the light-emitting device driving circuit, the switch control circuit includes a timing control circuit and an SR latch. The timing control circuit is coupled to the control terminal and the second terminal of the switch to generate a turning-on control signal and also compares the conducting-current value of the switch and the reference-current value when the switch is turned on so as to generate a comparing result. The timing control circuit dynamically adjusts an output time of the turning-on control signal according to the comparing result. A set terminal and a reset terminal of the SR latch receive the turning-on control signal and the turning-off control signal respectively. An output terminal of the SR latch is coupled to the control terminal of the switch.

According to an embodiment of the light-emitting device driving circuit of the present invention, the timing control circuit includes a comparison circuit and an adaptive timing-generating circuit. The comparison circuit is coupled to the control terminal and the second terminal of the switch to compare the conducting-current value of the switch and the reference-current value to generate the comparing result when the switch is turned on. The adaptive timing-generating circuit is coupled to the control terminal of the switch to generate the turning-on control signal and to dynamically adjust an output time of the turning-on control signal according to the comparing result when the switch is turned on.

According to an embodiment of the light-emitting device driving circuit, the comparison circuit includes a comparator. An input terminal of the comparator receives the reference-current value, and the other input terminal is coupled to the second terminal of the switch. The comparator also determines whether or not to compare the signals received by the two input terminals to generate the comparing result according to magnitude of the voltage at the control terminal of the switch.

According to an embodiment of the light-emitting device driving circuit, the adaptive timing-generating circuit includes a timing and logic control circuit, a charge pump, a low-pass filter, and a voltage-time converter. The timing and logic control circuit determines whether or not to proceed with operation according to magnitude of the voltage at the control terminal of the switch and outputs a control-increase signal or a control-decrease signal during operation according to the comparing result. The charge pump has a current supply terminal. When receiving the control-increase signal, the charge pump supplies current from the current supply terminal. When receiving the control-decrease signal, the charge pump sinks current from the current supply terminal. The low-pass filter is coupled to the current supply terminal and generates a control voltage according to a current direction on the current supply terminal. The voltage-time converter is coupled to the low-pass filter to output the turning-on control signal. The voltage-time converter also dynamically adjusts an output time of the turning-on control signal according to the control voltage.

According to an embodiment of the light-emitting device driving circuit and the light-emitting device driving method, the said reference-current value is a minimum current value of the said inductor.

In the present invention, a specially made timing control circuit is adopted to manufacture the switch control circuit in the light-emitting device driving circuit. As a result, the switch control circuit not only turns off the switch according to the turning-off control signal outputted by the current-sensing circuit, but also compares the conducting-current value of the switch and the reference-current value when the switch is turned on so as to generate the comparing result and dynamically adjust the time length of turning off the switch according to the comparing result. Thus, the value of the inductor current $I_L$ is automatically locked within a predetermined range.

In order to make the aforementioned and other objects, features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
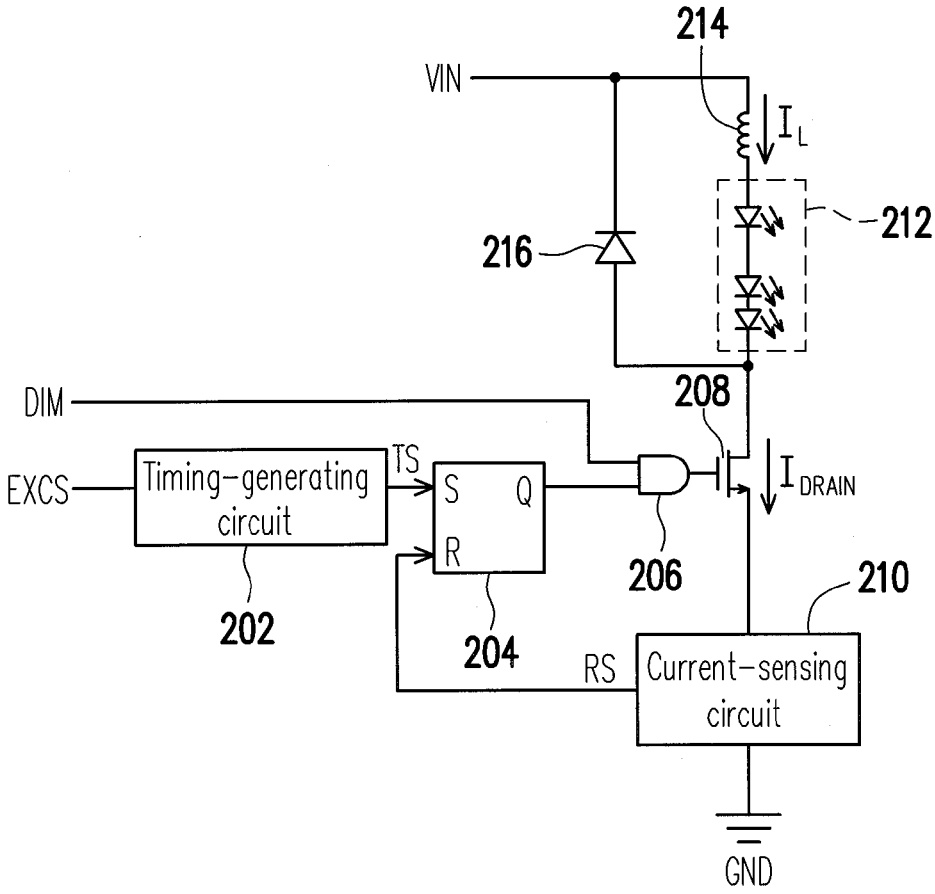
FIG. 1 (PRIOR ART)
FIG. 1 shows a conventional buck type light-emitting diode (LED) driving circuit which senses source current of a metal oxide semiconductor (MOS) transistor and a coupling method of the light-emitting diode driving circuit.
Figure 2:
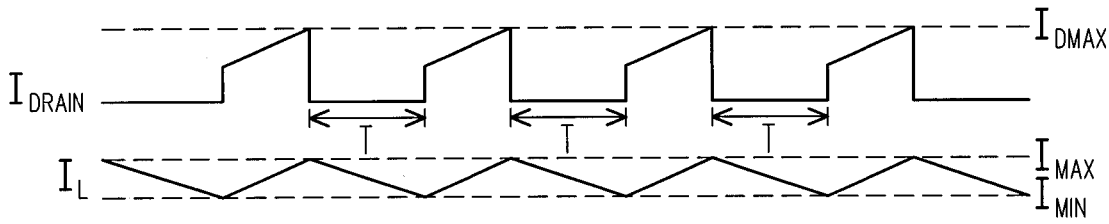
FIG. 2 (PRIOR ART)
FIG. 2 is an oscillogram of the currents $I_L$ and $I_{DRAIN}$ in the circuit shown by FIG. 1.
Figure 3:
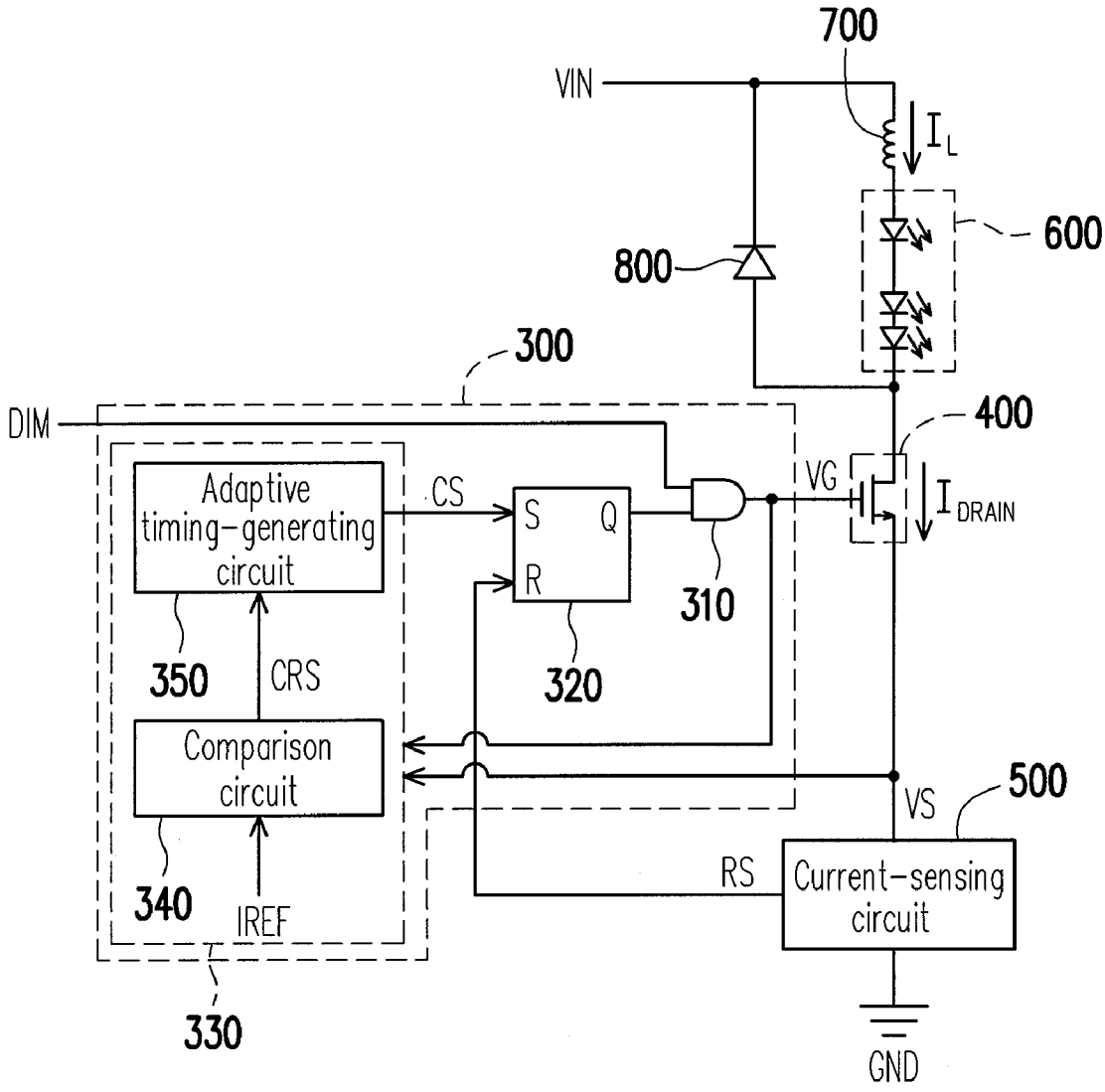
FIG. 3 is a light-emitting device driving circuit and a coupling method thereof according to an embodiment of the present invention.

FIG. 3 is a light-emitting device driving circuit and a coupling method thereof according to an embodiment of the present invention. The light-emitting device driving circuit includes a switch control circuit 300, a switch 400 and a current-sensing circuit 500 to drive a light-emitting device 600. A terminal of the light-emitting device 600 is coupled to a supply voltage VIN and the cathode of a diode 800 via an inductor 700. The other terminal of the light-emitting device 600 is coupled to the anode of the diode 800. In the present embodiment, the light-emitting device 600 consists of a plurality of light-emitting diodes (LEDs) and the supply voltage VIN is a direct current (DC) voltage. The switch 400 is implemented by an NMOS transistor. Certainly, the switch 400 may also implemented by PMOS transistors, bipolar junction transistors (BJTs) or other types of transistors.

A first terminal of the switch 400 is coupled to the other terminal of the light-emitting device 600. The current-sensing circuit 500 is coupled to a second terminal of the switch 400 and determines whether or not to generate a turning-off control signal RS according to a conducting-current value of the switch 400 (i.e., a value of a conducting-current $I_{DRAIN}$). The switch control circuit 300 is coupled to the current-sensing circuit 500 and a control terminal and the second terminal of the switch 400 to control the on/off state of the switch 400. When the switch control circuit 300 turns on the switch 400, the switch control circuit 300 compares the conducting-current value of the switch 400 and a reference-current IREF value to generate a comparing result CRS. The switch control circuit 300 turns off the switch 400 according to the turning-off control signal RS and dynamically adjusts a time length of turning off the switch 400 according the comparing result CRS. According to the present embodiment, the reference-current IREF is a minimum current value of the inductor 700.

The switch control circuit 300 includes an AND gate 310, an SR latch 320 and a timing control circuit 330. The timing control circuit 330 is coupled to the control terminal and the second terminal of the switch 400 to generate a turning-on control signal CS. When the switch 400 is turned on, the timing control circuit 330 compares the conducting-current value of the switch 400 and the reference-current value IREF to generate the comparing result CRS and dynamically adjusts an output time of the turning-on control signal CS according to the comparing result CRS. A set terminal S and a reset terminal R of the SR latch 320 receive the turning-on control signal CS and the turning-off control signal RS respectively. Two input terminals of the AND gate 310 are coupled to a dimming signal DIM and an output terminal Q of the SR latch 320 respectively. The output terminal of the AND gate 310 is coupled to the control terminal of the switch 400. According to the present embodiment, the SR latch 320 is a positively triggered type, and the dimming signal DIM can be implemented by a PWM signal.

The timing control circuit 330 includes a comparison circuit 340 and an adaptive timing-generating circuit 350. The comparison circuit 340 is coupled to the control terminal and the second terminal of the switch 400 to compare the conducting-current value of the switch 400 and the reference-current value IREF so as to generate the comparing result CRS when the switch 400 is turned on. The adaptive timing-generating circuit 350 is coupled to the control terminal of the switch 400 to generate the turning-on control signal CS and to dynamically adjust the output time of the turning-on control signal CS according to the comparing result CRS when the switch 400 is turned on.

It is noted that although in the present embodiment a method of coupling the light-emitting device 600 with the inductor 700 is described, the coupling method is not meant to limit the present invention. People having ordinary skill in the art should know that even if positions of the two foregoing components are exchanged, as long as the anodes of all the light-emitting diodes in the light-emitting device 600 face the supply voltage VIN and are connected in series, the present invention can be implemented. Furthermore, according to the present embodiment, the current-sensing circuit 500 can be easily implemented by a resistance circuit to provide the turning-off control signal RS and a voltage signal VS in positive proportion to the conducting-current value of the switch 400. Thus, the comparison circuit 340 can be implemented by common comparators, as shown in FIG. 4.

Figure 4:
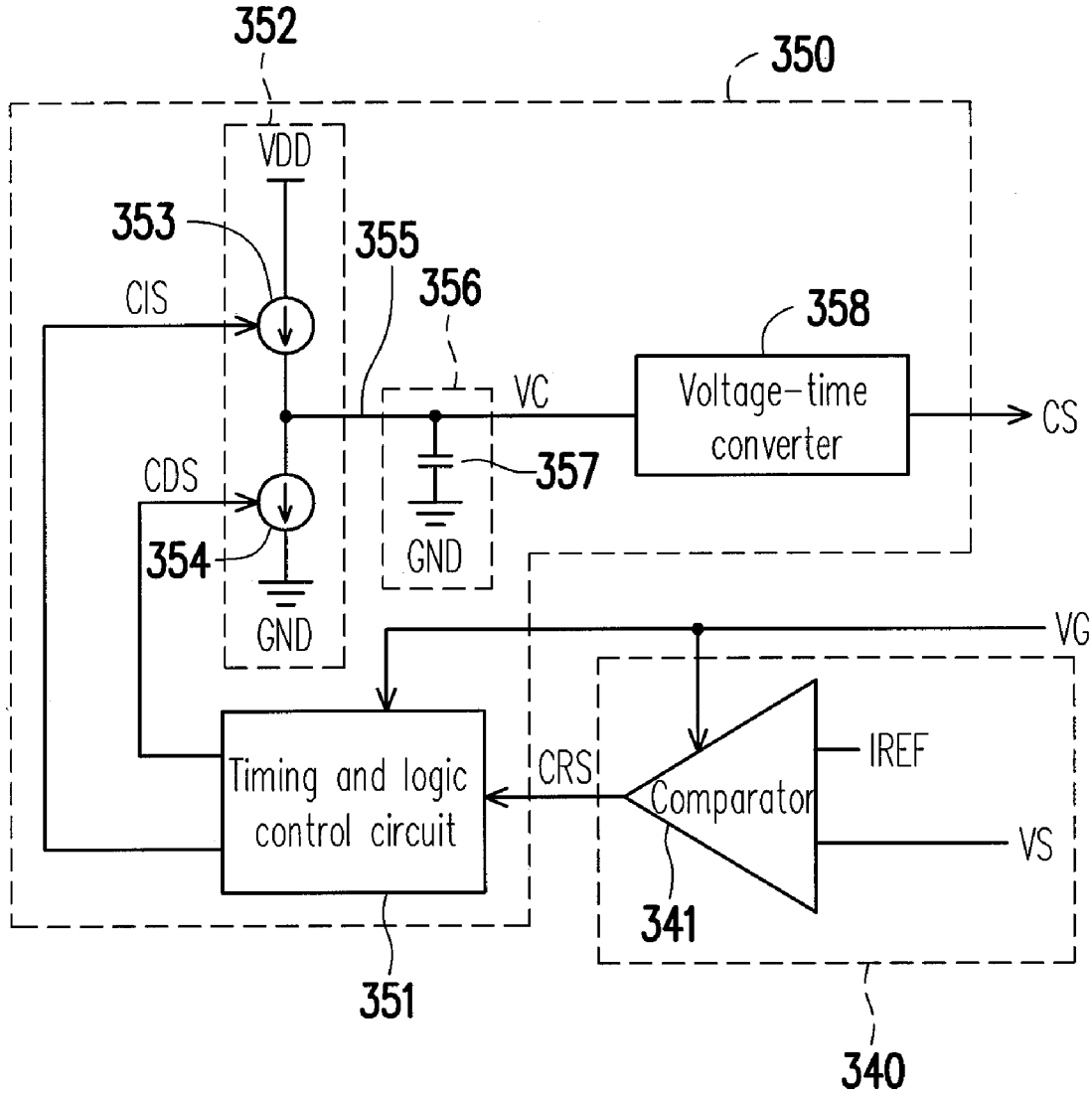
FIG. 4 is a method of implementing a comparison circuit 340 and an adaptive timing-generating circuit 350 according to an embodiment of the present invention.

FIG. 4 shows a method of implementing a comparison circuit 340 and an adaptive timing-generating circuit 350 according to an embodiment of the present invention. As shown in FIG. 4, the comparison circuit 340 includes a comparator 341. An input terminal of the comparator 341 receives a voltage analogous to the reference-current value IREF; the voltage and the reference-current value IREF are in positive proportion. The other input terminal of the comparator 341 is coupled to the second terminal of the switch 400 to receive the voltage signal VS of the coupling between the switch 400 and the current-sensing circuit 500. The comparator 341 determines whether or not to compare the signals received by the two input terminals according to magnitude of a voltage VG at the control terminal of the switch 400 so as to generate a comparing result CRS.

The adaptive timing-generating circuit 350 includes a timing and logic control circuit 351, a charge pump 352, a low-pass filter 356 and a voltage-time converter 358. The timing and logic control circuit 351 determines whether or not to proceed with operation according to magnitude of the voltage VG at the control terminal of the switch 400. The timing and logic control circuit 351 outputs a control-increase signal CIS or a control-decrease signal CDS during operation according to the comparing result CRS. The charge pump 352 has a current supply terminal 355. When receiving the control-increase signal CIS, the charge pump 352 supplies current to the current supply terminal 355. When receiving the control-decrease signal CDS, the charge pump 352 sinks current from the current supply terminal 355. The low-pass filter 356 is coupled to the current supply terminal 355 and generates a control voltage VC according to a current direction on the current supply terminal 355. The voltage-time converter 358 is coupled to the low-pass filter 356 to output the turning-on control signal CS and dynamically adjusts an output time of the turning-on control signal CS according to magnitude of the control voltage VC.

The charge pump 352 is implemented by controlled current sources 353 and 354. The controlled current source 353 is coupled between a supply voltage VDD and the current supply terminal 355 and controlled by the control-increase signal CIS. The controlled current source 354 is coupled between the current supply terminal 355 and a common voltage GND and controlled by the control-decrease signal CDS. As to the low-pass filter 356, it is implemented by a capacitor 357. According to the present embodiment, the comparator 341 and the timing and logic control circuit 351 only start operating when the voltage VG at the control terminal of the switch 400 is at a high voltage level and do not operate otherwise.

Figure 5:
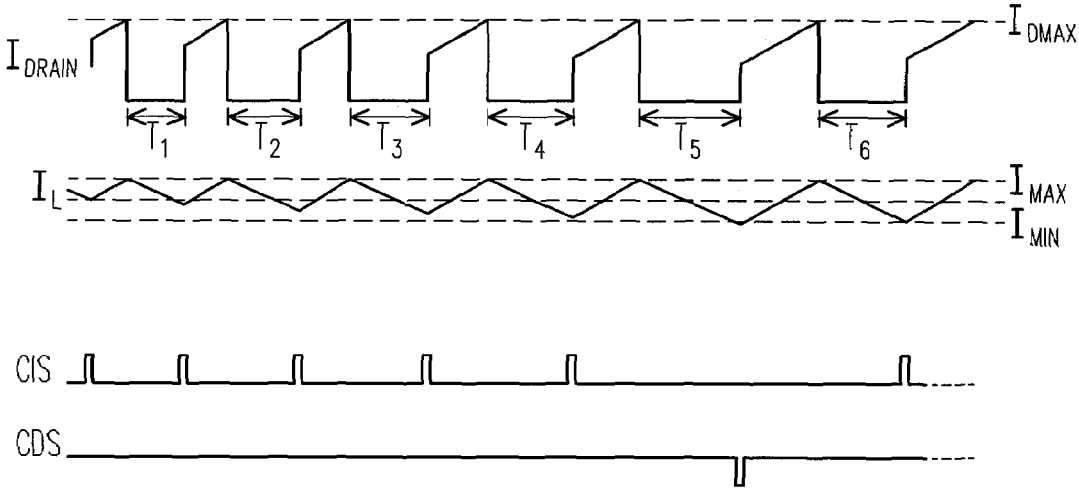
FIG. 5 are oscillorgrams showing the inductor current $I_L$ and the conducting-current $I_{DRAIN}$ of the switch 400 in FIG. 3 and the control-increase signal CIS and the control-decrease signal CDS in FIG. 4.

FIG. 5 are oscillorgrams showing the inductor current $I_L$ and the conducting-current $I_{DRAIN}$ of the switch 400 in FIG. 3 and the control-increase signal CIS and the control-decrease signal CDS in FIG. 4. Referring to both FIGS. 4 and 5, when the comparator 341 determines that the voltage VG at the control terminal of the switch 400 changes from a low voltage level to a high voltage level, the comparator 341 compares magnitude of the voltage signal VS and the voltage analogous to the reference-current value IREF. Such comparison is the same as comparing magnitude of the value of the conducting-current $I_{DRAIN}$ and the reference-current value IREF. If the comparator 341 determines that the value of the voltage signal VS is larger than the voltage value analogous to the reference-current value IREF, the minimum value of the inductor current $I_L$ within a cycle is larger than a predetermined minimum current value $I_{MIN}$, and therefore the timing and logic control circuit 351 outputs the control-increase signal CIS. On the contrary, the minimum value of the inductor current $I_L$ within a cycle is smaller than the predetermined minimum current value $I_{MIN}$, and therefore the timing and logic control circuit 351 outputs the control-decrease signal CDS. Each pulse of the control-increase signal CIS and each pulse of the control-decrease signal CDS have fixed time lengths.

When receiving the control-increase signal CIS, the controlled current source 353 supplies current to the current supply terminal 355 so that the control voltage VC rises. When receiving the control-decrease signal CDS, the controlled current source 354 sinks current from the current supply terminal 355 so that the control voltage VC drops. Thus, the voltage-time converter 358 dynamically adjusts the output time of the turning-on control signal CS according to magnitude of the control voltage VC to control a time length of turning off the switch 400 via the SR latch 320 and the AND gate 310, as shown by times T1, T2, T3 . . . in FIG. 5. Specifically, when the minimum value of the inductor current $I_L$ within a cycle is larger than the minimum current value $I_{MIN}$, the time length of turning off the switch 400 is prolonged. When the minimum value of the inductor current $I_L$ within a cycle is smaller than the minimum current value $I_{MIN}$, the time length of turning off the switch 400 is shortened. If T1 is a given time in the beginning of circuit operation, T1 may be a random reasonable value. It follows that during early operation of the switch control circuit 300, the time length of turning off the switch 400 is constantly adjusted. However, as a period of time passes, the time length of turning off the switch 400 would gradually stabilize and thus the value of the inductor current $I_L$ is automatically locked between the maximum current value $I_{MAX}$ and the minimum current value $I_{MIN}$. Moreover, it is to be noted that in FIG. 5 $I_{DMAX}$ is equal to $I_{MAX}$.

Although in the above embodiment the current-sensing circuit 500 is coupled between the switch 400 and the common voltage GND to perform current sensing, such sensing method is not meant to limit the present invention. People having skill in the art should know that even if the second terminal of the switch 400 is directly coupled to the common voltage GND, other methods may still be used to sense current. In addition, it should be noted that if the light-emitting device driving circuit does not need to have a function of adjusting luminance of a light source emitted from the LED string 600, the AND gate 310 and the dimming signal DIM are not required. Only the output terminal Q of the SR latch 320 needs to be directly coupled to the control terminal of the switch 400.

Figure 6:
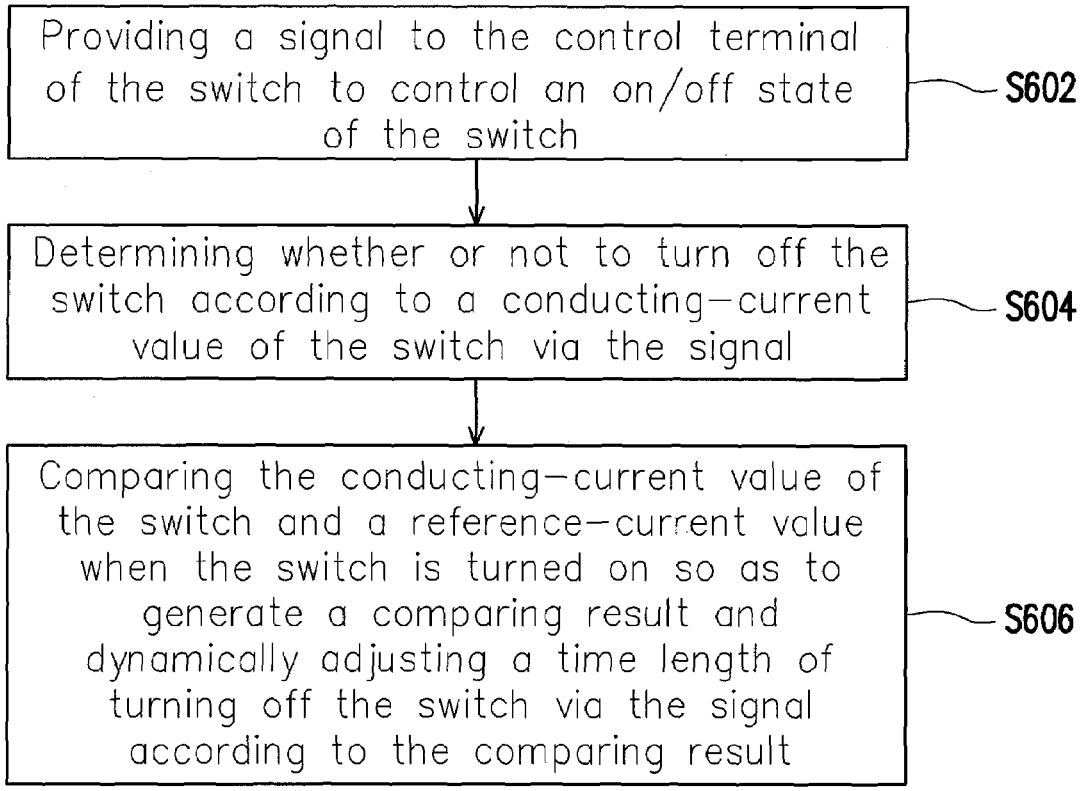
FIG. 6 is a flowchart of steps showing a light-emitting device driving method according to an embodiment of the present invention.

From the teachings of the above embodiment, a light-emitting device driving method is induced. A terminal of a light-emitting device is coupled to a supply voltage and the cathode of a diode via an inductor. The other terminal of the light-emitting device is coupled to the anode of the diode and a first terminal of the switch. A second terminal of the switch is coupled to a common voltage. FIG. 6 is a schematic flowchart of steps showing a light-emitting device driving method according to an embodiment of the present invention. Referring to FIG. 6, the light-emitting device driving method includes following steps. First, a signal is provided to a control terminal of the switch to control the on/off state of the switch (as shown in a step S602). Second, whether or not to turn off the switch via the signal is determined by a conducting-current value of the switch (as shown in a step S604). Third, when the switch is turned on, the conducting-current value of the switch and a reference-current value are compared to generate a comparing result and a time length of turning off the switch is dynamically adjusted according to the comparing result via the signal (as shown in a step S606). Certainly, as previously described, the positions of the light-emitting device and the inductor may also be exchanged, which does not affect how the driving method operates.

In summary, in the present invention, a specially made timing control circuit is adopted to manufacture the switch control circuit in the light-emitting device driving circuit. As a result, the switch control circuit not only turns off the switch according to the turning-off control signal outputted by the current-sensing circuit, but also compares the conducting-current value of the switch and the reference-current value when the switch is turned on so as to generate the comparing result and dynamically adjust the time length of turning off the switch according to the comparing result. Thus, the value of the inductor current $I_L$ is automatically locked within a predetermined range. Additionally, if the light-emitting device driving circuit of the present invention is manufactured as a circuit chip, no additional pins are required to be designed. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A light-emitting device driving circuit, adapted to driving a light-emitting device, wherein a terminal of the light-emitting device is coupled to a supply voltage and a cathode of a diode via an inductor and the other terminal of the light-emitting device is coupled to an anode of the diode, the light-emitting device driving circuit comprising:

a switch, having a first terminal, a second terminal and a control terminal, the first terminal of the switch being coupled to the other terminal of the light-emitting device;

a current-sensing circuit, coupled to the second terminal of the switch and determining whether or not to generate a turning-off control signal according to a conducting-current value of the switch; and a switch control circuit, coupled to the current-sensing circuit and the control terminal and the second terminal of the switch to control an on/off state of the switch, wherein when the switch control circuit turns on the switch, the switch control circuit compares the conducting-current value of the switch and a reference-current value to generate a comparing result, turns off the switch according to the turning-off control signal, and dynamically adjusts a turning-off time length of the switch according to the comparing result.

2. The light-emitting device driving circuit as claimed in claim 1, wherein the switch control circuit comprises:

a timing control circuit, coupled to the control terminal and the second terminal of the switch to generate a turning-on control signal, comparing the conducting-current value of the switch and the reference-current value when the switch is turned on so as to generate the comparing result, and dynamically adjusting an output time of the turning-on control signal according to the comparing result; and an SR latch, having a set terminal, a reset terminal and an output terminal, the set terminal and the reset terminal of the SR latch receiving the turning-on control signal and the turning-off control signal respectively, the output terminal of the SR latch being coupled to the control terminal of the switch.

3. The light-emitting device driving circuit as claimed in claim 2, wherein the timing control circuit comprises:

a comparison circuit, coupled to the control terminal and the second terminal of the switch to compare the conducting-current value of the switch and the reference-current value when the switch is turned on so as to generate the comparing result; and an adaptive timing-generating circuit, coupled to the control terminal of the switch to generate the turning-on control signal and dynamically adjusting the output time of the turning-on control signal according to the comparing result when the switch is turned on.

4. The light-emitting device driving circuit as claimed in claim 3, wherein the comparison circuit comprises:

a comparator, an input terminal of the comparator receiving the reference-current value, the other input terminal being coupled to the second terminal of the switch, the comparator determining whether or not to compare signals received by the two input terminals according to magnitude of a voltage at the control terminal of the switch so as to generate the comparing result.

5. The light-emitting device driving circuit as claimed in claim 3, wherein the adaptive timing-generating circuit comprises:

a timing and logic control circuit, determining whether or not to proceed with operation according to magnitude of the voltage at the control terminal of the switch and outputting a control-increase signal or a control-decrease signal during operation according to the comparing result;

a charge pump, having a current supply terminal, when receiving the control-increase signal, the charge pump supplying current from the current supply terminal, when receiving the control-decrease signal, the charge pump sinking current from the current supply terminal;

a low-pass filter, coupled to the current supply terminal and generating a control voltage according to a current direction on the current supply terminal; and a voltage-time converter, coupled to the low-pass filter to output the turning-on control signal and dynamically adjusting the output time of the turning-on control signal according to the control voltage.

6. The light-emitting device driving circuit as claimed in claim 2, wherein the switch control circuit comprises:

an AND gate, two input terminals of the AND gate being coupled to a dimming signal and the output terminal of the SR latch respectively, the output terminal of the AND gate being coupled to the control terminal of the switch.

7. The light-emitting device driving circuit as claimed in claim 1, wherein the light-emitting device consists of a plurality of serially-connected light-emitting diodes (LEDs), the supply voltage being a direct current (DC) voltage.

8. The light-emitting device driving circuit as claimed in claim 1, wherein the reference-current value is a minimum current value of the inductor.

9. A light-emitting device driving method, wherein a terminal of the light-emitting device is coupled to a supply voltage and a cathode of a diode via an inductor, and the other terminal of the light-emitting device is coupled to an anode of the diode and a first terminal of a switch, a second terminal of the switch being coupled to a common voltage, the light-emitting device driving method comprising:

providing a signal to a control terminal of the switch to control an on/off state of the switch;

determining whether or not to turn off the switch via the signal according to a conducting-current value of the switch; and comparing the conducting-current value and a reference-current value to generate a comparing result when the switch is turned on and dynamically adjusting a turning-off time length of the switch via the signal according to the comparing result.

10. The light-emitting device driving circuit as claimed in claim 9, wherein the light-emitting device consists of a plurality of serially-connected LEDs, the supply voltage being a DC voltage.

11. The light-emitting device driving circuit as claimed in claim 9, wherein the reference-current value is a minimum current value of the inductor.

12. A light-emitting device driving circuit, adapted to driving a light-emitting device, the light-emitting device driving circuit comprising:

a switch, having a first terminal, a second terminal and a control terminal, the first terminal of the switch being coupled to the light-emitting device;

a current-sensing circuit, coupled to the second terminal of the switch and determining whether or not to generate a turning-off control signal according to a conducting-current value of the switch; and a switch control circuit, coupled to the current-sensing circuit and the control terminal and the second terminal of the switch to control an on/off state of the switch, wherein when the switch control circuit turns on the switch, the switch control circuit compares the conducting-current value of the switch and a reference-current value to generate a comparing result, turns off the switch according to the turning-off control signal, and dynamically adjusts a turning-off time length of the switch according to the comparing result.

13. A light-emitting device driving method for dynamically adjusting a turn-off time length of a switch, the light-emitting device driving method comprising:

providing a signal to a control terminal of the switch to control an on/off state of the switch;

determining whether or not to turn off the switch according to a conducting-current value of the switch; and comparing the conducting-current value of the switch and a reference-current value to generate a comparing result when the switch is turned on and dynamically adjusting the turning-off time length of the switch via the signal according to the comparing result.

* * * * *